US009894928B2

(12) United States Patent
Li et al.

(10) Patent No.: US 9,894,928 B2
(45) Date of Patent: Feb. 20, 2018

(54) ADDITIVES FOR TOBACCO CUT FILLER

(71) Applicant: Philip Morris USA Inc., Richmond, VA (US)

(72) Inventors: San Li, Midlothian, VA (US); Raquel Olegario, Richmond, VA (US); Joseph L. Banyasz, Richmond, VA (US); Kenneth H. Shafer, Sutherland, VA (US)

(73) Assignee: Philip Morris USA Inc., Richmond, VA (US)

( * ) Notice: Subject to any disclaimer, the term of this patent is extended or adjusted under 35 U.S.C. 154(b) by 42 days.

(21) Appl. No.: 14/563,768

(22) Filed: Dec. 8, 2014

(65) Prior Publication Data

US 2015/0150304 A1 Jun. 4, 2015

Related U.S. Application Data

(60) Continuation of application No. 13/595,925, filed on Aug. 27, 2012, now abandoned, which is a division of application No. 11/252,850, filed on Oct. 19, 2005, now abandoned.

(60) Provisional application No. 60/621,546, filed on Oct. 25, 2004.

(51) Int. Cl.

| | |
|---|---|
| ***A24B 15/10*** | (2006.01) |
| ***A24B 15/28*** | (2006.01) |
| ***A24B 15/24*** | (2006.01) |
| ***A24B 15/30*** | (2006.01) |
| ***A24B 15/42*** | (2006.01) |
| ***A24D 1/00*** | (2006.01) |
| ***A24D 3/02*** | (2006.01) |

(52) U.S. Cl.

CPC ..... *A24B 15/287* (2013.01); *A24B 15/246* (2013.01); *A24B 15/30* (2013.01); *A24B 15/42* (2013.01); *A24D 1/002* (2013.01); *A24D 3/02* (2013.01)

(58) Field of Classification Search

None

See application file for complete search history.

(56) References Cited

U.S. PATENT DOCUMENTS

| | | | | |
|---|---|---|---|---|
| 3,046,996 | A | | 7/1962 | Gary |
| 3,638,660 | A | | 2/1972 | Davis |
| 3,861,401 | A | | 1/1975 | Briskin et al. |
| 3,861,402 | A | | 1/1975 | Briskin |
| 3,885,574 | A | | 5/1975 | Borthwick et al. |
| 3,929,141 | A | | 12/1975 | Beringer et al. |
| 4,019,520 | A | | 4/1977 | Strubel et al. |
| 4,055,191 | A | | 10/1977 | Norman et al. |
| 4,117,850 | A | | 10/1978 | Wood |
| 4,177,822 | A | | 12/1979 | Bryant, Jr. et al. |
| 4,197,861 | A | | 4/1980 | Keith |
| 4,216,784 | A | | 8/1980 | Norman et al. |
| 4,235,251 | A | | 11/1980 | Bryant, Jr. et al. |
| 4,257,430 | A | | 3/1981 | Collins et al. |
| 4,333,484 | A | | 6/1982 | Keritsis |
| 4,506,684 | A | | 3/1985 | Keritsis |
| 4,811,745 | A | | 3/1989 | Cohen et al. |
| 4,827,949 | A | | 5/1989 | Sunas |
| 4,955,399 | A | | 9/1990 | Potter et al. |
| 4,964,426 | A | | 10/1990 | Lee et al. |
| 5,038,803 | A | | 8/1991 | Cohen et al. |
| 5,074,321 | A | | 12/1991 | Gentry et al. |
| 5,101,839 | A | | 4/1992 | Jakob et al. |
| 5,105,836 | A | | 4/1992 | Gentry et al. |
| 5,129,408 | A | | 7/1992 | Jakob et al. |
| 5,131,414 | A | * | 7/1992 | Fagg ..... A24B 15/24 131/297 |
| 5,183,062 | A | | 2/1993 | Clearman et al. |
| 5,211,684 | A | * | 5/1993 | Shannon ..... A24B 15/165 131/194 |
| 5,247,947 | A | | 9/1993 | Clearman et al. |
| 5,360,022 | A | | 11/1994 | Newton et al. |
| 5,533,530 | A | | 7/1996 | Young et al. |
| 5,598,868 | A | | 2/1997 | Jakob et al. |
| 5,690,127 | A | | 11/1997 | Chapman et al. |

(Continued)

FOREIGN PATENT DOCUMENTS

| | | |
|---|---|---|
| EP | 0390419 A2 | 10/1990 |
| GB | 863287 | 3/1961 |

(Continued)

OTHER PUBLICATIONS

International Search Report and Written Opinion of the International Searching Authority (Forms PCT/ISA/210 and PCT/ISA/237) dated Apr. 20, 2006, by the International Bureau of WIPO, in corresponding International Application No. PCT/IB2005/003558. (10 pages).

International Preliminary Report on Patentability and Written Opinion of the International Searching Authority (Forms PCT/IB/326 and PCT/ISA/237) dated May 10, 2007, by the International Bureau of WIPO, in corresponding International Application No. PCT/IB2005/003558. (4 pages).

*Primary Examiner* — Cynthia Szewczyk

(74) *Attorney, Agent, or Firm* — Buchanan Ingesoll & Rooney PC

(57) ABSTRACT

Tobacco smoking mixtures capable of producing tobacco smoke are provided which reduce the cytotoxicity and/or mutagenicity of the tobacco smoke. The tobacco smoking mixtures include tobacco cut filler and glycerin in an amount effective to reduce cytotoxicity and/or mutagenicity of smoke produced by the tobacco smoking mixture. The tobacco smoking mixtures enable a further reduction in cytotoxicity and/or mutagenicity when glycerin is combined with palladium or salts of calcium and/or magnesium.

12 Claims, No Drawings

(56) References Cited

U.S. PATENT DOCUMENTS

| | | | | |
|---|---|---|---|---|
| 5,715,844 | A | 2/1998 | Young et al. | |
| 7,237,558 | B2 | 7/2007 | Clark et al. | |
| 2003/0000538 | A1* | 1/2003 | Bereman ..... | A24B 15/245<br>131/352 |
| 2003/0145869 | A1 | 8/2003 | Kitao et al. | |
| 2005/0066983 | A1 | 3/2005 | Clark et al. | |
| 2005/0121044 | A1 | 6/2005 | Banerjee et al. | |

FOREIGN PATENT DOCUMENTS

| | | |
|---|---|---|
| GB | 908185 | 10/1962 |
| GB | 1255657 | 12/1971 |
| GB | 1299641 | 12/1972 |
| GB | 1362611 | 8/1974 |
| GB | 1362751 | 8/1974 |
| GB | 1364104 | 8/1974 |
| GB | 1381027 | 1/1975 |
| GB | 1413271 | 11/1975 |
| GB | 1415893 | 12/1975 |
| GB | 1471943 | 4/1977 |
| GB | 1475315 | 6/1977 |

* cited by examiner

ADDITIVES FOR TOBACCO CUT FILLER

RELATED APPLICATIONS

This application is a continuation application of U.S. application Ser. No. 13/595,925, filed Aug. 27, 2012 which is a divisional application of U.S. application Ser. No. 11/252,850, filed Oct. 19, 2005 which claims priority under 35 U.S.C. § 119(e) to U.S. Provisional Application No. 60/621,546 entitled ADDITIVES FOR TOBACCO CUT FILLER and filed on Oct. 25, 2004, the entire content of each is hereby incorporated by reference.

SUMMARY

A tobacco smoking mixture for a smoking article such as a cigarette and a method of using the tobacco smoking mixture for reducing the cytotoxicity and mutagenicity of tobacco smoke is provided. A tobacco smoking mixture containing additives for tobacco used in smoking articles is provided wherein the additives serve to reduce the cytotoxicity and mutagenicity of the smoke generated upon the smoking article being smoked.

Tobacco smoke contains a highly complex chemical mixture of compounds which may contribute to cytotoxicity or mutagenicity. By way of example, tobacco smoke contains polycyclic aromatic hydrocarbons which may contribute to smoke mutagenicity and chemicals known as "phenolics" which may contribute to smoke cytotoxicity. Phenolics include, for example, hydroquinone, catechol, cresol, phenol and resorcinol. Removal or reduction of one or more of these compounds may result in reduced smoke bioactivities.

In one embodiment, a tobacco smoking mixture capable of producing smoke when burned is provided comprising tobacco and a mixture of palladium and glycerin wherein the glycerin is present in an amount of about 8 to about 13% by weight of the tobacco smoking mixture, and wherein the mixture of glycerin and palladium is present in an amount effective to reduce the cytotoxicity and/or the mutagenicity of the smoke produced when the tobacco smoking mixture is burned.

In another embodiment, a tobacco smoking mixture capable of producing smoke when burned is provided comprising tobacco and a mixture of glycerin and magnesium or calcium salts selected from the group consisting of magnesium nitrate, magnesium chloride, magnesium acetate, magnesium sulfate, calcium nitrate, calcium chloride, calcium acetate, calcium sulfate and a mixture thereof, wherein the glycerin is present in an amount of about 8 to about 13% by weight of the tobacco smoking mixture, and wherein the mixture of glycerin and magnesium or calcium salts is present in an amount effective to reduce the cytotoxicity and/or the mutagenicity of the smoke produced when the tobacco smoking mixture is burned.

In a further embodiment, a tobacco smoking mixture capable of producing smoke when burned is provided comprising tobacco, and a mixture of about 8 to about 13% by weight glycerin and about 0.03 to about 0.10% by weight palladium salt, wherein the mixture of glycerin and palladium salt effectively reduce the cytotoxicity and/or mutagenicity of the smoke produced when the tobacco smoking mixture is burned.

In a further embodiment, a tobacco smoking mixture capable of producing smoke when burned is provided comprising tobacco, and a mixture of about 8 to about 13% by weight glycerin and about 3 to about 8% by weight of magnesium or calcium salts selected from the group consisting of magnesium nitrate, magnesium chloride, magnesium acetate, magnesium sulfate, calcium nitrate, calcium chloride, calcium acetate, calcium sulfate and a mixture thereof, wherein the mixture of glycerin and magnesium or calcium salts effectively reduce the cytotoxicity and/or mutagenicity of the smoke produced when the tobacco smoking mixture is burned.

In a further embodiment, a tobacco smoking mixture capable of producing smoke when burned is provided comprising at least about 85% by weight tobacco cut filler and about 8 to about 13% by weight glycerin, wherein the glycerin effectively reduces the cytotoxicity and/or mutagenicity of the smoke produced when the tobacco smoking mixture is burned by at least about 10% of smoke particulate phase cytotoxicity and/or mutagenicity.

In a further embodiment, a tobacco smoking mixture capable of producing smoke when burned is provided comprising at least about 85% by weight tobacco cut filler and about 3 to about 8% by weight of magnesium or calcium salts selected from the group consisting of magnesium nitrate, magnesium chloride, magnesium acetate, magnesium sulfate, calcium nitrate, calcium chloride, calcium acetate, calcium sulfate and a mixture thereof, wherein the magnesium or calcium salts effectively reduce the cytotoxicity and/or mutagenicity of the smoke produced when the tobacco smoking mixture is burned by at least about 10% of smoke particulate phase cytotoxicity and/or mutagenicity.

DETAILED DESCRIPTION

Tobacco smoking mixtures which reduce tobacco smoke cytotoxicity and/or mutagenicity are provided comprising glycerin in particular amounts added to tobacco to form a tobacco smoking mixture capable of producing smoke when burned. The tobacco smoking mixtures result in the reduction of cytotoxicity and/or mutagenicity in the tobacco smoke produced from such tobacco smoking mixtures. In addition, tobacco smoking mixtures comprising tobacco and a mixture of glycerin with other agents further reduces the cytotoxicity and/or the mutagenicity of tobacco smoke produced from the tobacco smoking mixture.

As used herein, cytotoxicity means cellular injury or cellular death as measured by any conventional assay used in the art. Assays for measuring cytotoxicity are known by those of skill in the art. By way of example, the neutral red uptake assay may be used to measure cytotoxicity. Typically, cytotoxicity is measured as the number of cells killed upon exposure to a particular component. Cytotoxicity of tobacco smoke may be measured in the particulate phase or gas phase. It is believed that a reduction of cytotoxicity in tobacco smoke reflects a reduction in phenolics in the tobacco smoke.

As used herein, mutagenicity means mutation of bacteria and is typically measured by the number of bacteria affected or mutated upon exposure to a particular component. Assays for measuring mutagenicity are known by those of skill in the art. By way of example, the Ames test may be used to measure mutagenicity of tobacco smoke. The Ames Test is a study whereby bacteria are exposed to a substance to determine if that substance may cause genetic mutations. It is believed that a reduction of mutagenicity reflects a reduction of polycyclic aromatic hydrocarbons in the tobacco smoke.

As used herein, "reduce cytotoxicity and/or mutagenicity" means that the tobacco smoking mixture will exhibit a decrease in either cytotoxicity as measured by known assay techniques suitable for testing tobacco smoke or a decrease in mutagenicity as measured by known assay techniques suitable for testing tobacco smoke or that a decrease in both cytotoxicity and mutagenicity is exhibited when tested as indicated. The applied bio-assay techniques may have variation ranges of 21% (mutagenicity assay), 27% (cytotoxicity of TPM), and 43% (cytotoxicity of gas-vapor phase).

In the tobacco smoking mixtures, glycerin, a polyol, may be used in an amount effective to reduce cytotoxicity and/or mutagenicity of the smoke produced from the tobacco smoking mixture. Glycerin alone has been found to reduce particulate cytotoxicity and mutagenicity of tobacco smoke. Thus, glycerin is preferably used in an amount sufficient to effect a reduction of at least about 10% of smoke particulate phase cytotoxicity and/or mutagenicity. In a preferred embodiment, the amount of glycerin will be about 8 to about 13% by weight of the tobacco smoking mixture.

In one embodiment, glycerin is used in a mixture or combination with another additive or component which increases the reduction in cytotoxicity and/or mutagenicity of the smoke produced from the tobacco smoking mixture over the reduction when glycerin is the only cytotoxicity and/or mutagenicity reducing agent purposefully used. Typically, the mixture of glycerin and other component are used in an amount effective to reduce the cytotoxicity and/or mutagenicity of the smoke produced by the tobacco smoking mixture. Preferably, the mixture of glycerin and additional component is present in an amount effective to reduce the cytotoxicity and/or mutagenicity of the smoke produced by the tobacco smoking mixture by an amount of at least about 20%.

Glycerin, used in conjunction with palladium as an additional component in tobacco smoking mixtures capable of producing tobacco smoke further reduces the cytotoxicity and/or mutagenicity of the tobacco smoke generated from such a tobacco smoking mixture when compared to tobacco smoke from a tobacco smoking mixture with glycerin used as the sole constituent purposefully used for the reduction of cytotoxicity and/or mutagenicity.

The palladium may be used in any form, such as in metallic or salt form, but preferably is used in salt form. By way of example, palladium may be incorporated into the tobacco smoking mixture in the form of water-soluble palladium salts which are readily incorporated into and distributed throughout the tobacco smoking mixture. Such palladium salts are known in the art, and include such salts tetrachloropalladate salts such as $K_2PdCl_4$, among others.

The tobacco smoking mixtures may comprise tobacco and a mixture of glycerin and palladium an amount effective to reduce the cytotoxicity and/or mutagenicity of the smoke produced by the tobacco smoking mixture. Preferably, the palladium is used in an amount of about 0.03 to about 0.10% by weight and the glycerin is in an amount of about 8 to about 13% by weight. More preferably, the palladium is used in an amount of about 0.05 to about 0.09% by weight palladium.

Glycerin used in conjunction with a magnesium and/or calcium salt as an additional component in tobacco smoking mixtures capable of producing tobacco smoke further reduces the cytotoxicity and/or mutagenicity of the tobacco smoke generated from such a tobacco smoking mixture when compared to tobacco smoke from a tobacco smoking mixture with glycerin used as the sole constituent purposefully used for the reduction of cytotoxicity and/or mutagenicity. In particular, the addition of magnesium and/or calcium salts to a tobacco smoking mixture of tobacco and glycerin has been found to further reduce the cytotoxicity and/or mutagenicity of smoke resulting from such a tobacco smoking mixture. By way of example, the amount of hydroquinone in the smoke was reduced when glycerin alone was added to tobacco cut filler to form a tobacco smoking mixture capable of producing tobacco smoke. The amount of hydroquinone in the tobacco smoke produced from a tobacco smoking mixture of tobacco cut filler and glycerin was further reduced when magnesium and/or calcium salts were combined with glycerin in the tobacco smoking mixture comprising tobacco cut filler and glycerin. Although not wishing to be bound by any theory, it is believed that the reduction of hydroquinone in smoke is indicative of reductions of other phenolic compounds in smoke.

The magnesium and calcium salts typically include the nitrate, chloride, acetate and sulfate salts of magnesium or calcium. Specifically, the salts may be magnesium nitrate, magnesium chloride, magnesium acetate, magnesium sulfate, calcium nitrate, calcium chloride, calcium acetate or calcium sulfate. These salts may be used in combination, if desired. Preferably, the salts are either magnesium acetate, magnesium chloride or calcium chloride. The magnesium and calcium salts may be used in an amount effective to, in combination with the glycerin, reduce the cytotoxicity and/or mutagenicity of the tobacco smoke produced from the tobacco smoking mixture upon burning the tobacco smoking mixture. In a preferred embodiment, the magnesium salts, the calcium salts or the mixtures thereof are used in an amount of about 3 to about 8% by weight of the tobacco smoking mixture.

While a combination of glycerin and magnesium salts or calcium salts has been found to effectively reduce cytotoxicity and/or mutagenicity when used in a tobacco smoking mixture capable of producing smoke, it has also been discovered that magnesium and calcium salts may be used without glycerin in tobacco smoking mixtures to effect a lesser reduction of cytotoxicity and mutagenicity in the smoke resulting from such a tobacco smoking mixture. Magnesium and/or calcium salts may also be used in a mixture with glycerin and palladium to effect a reduction of cytotoxicity and/or mutagenicity.

The tobacco smoking mixture typically includes tobacco. The tobacco may comprise at least about 75% by weight based on the total weight of the mixture. The tobacco typically functions, inter alia, as fuel in the combustion/pyrolysis of the tobacco smoking mixture. The tobacco may include, but is not limited to, cut tobacco leaf filler (tobacco cut filler) that is typically found in cigarettes, expanded tobacco, extruded tobacco, reconstituted tobacco, tobacco stems, synthetic tobacco, and blends thereof. Tobacco cut filler preferably comprises at least about 75% of the total amount of tobacco in the tobacco smoking mixture, more preferably at least about 85% of the total amount of tobacco in the tobacco smoking mixture.

Additional additives may be included in the tobacco smoking mixture to improve various characteristics thereof. For example, taste modifiers may be added to the mixture to improve its flavor. In addition, burn additives may be used to impart desirable burn characteristics to the tobacco and/or cigarette paper wrapper.

The incorporation of the additives may take place at any time prior to the final packaging of the tobacco product. By way of example, in the case of cigarette tobacco, the added components may be incorporated before or after blending of the various tobaccos if blended tobacco is employed. The additives preferably are well dispersed throughout the tobacco so that the additives will be uniformly effective during the entire period during which the tobacco smoking mixture is smoked.

The tobacco smoking mixture may be manufactured using any suitable technique. For example, one method for manufacturing the mixture comprises the step of spraying tobacco with glycerin. To facilitate spraying, the glycerin preferably can be added to a liquid solution, and the solution can be sprayed onto the tobacco using conventional techniques. If glycerin and an additional component are to be used, a mixture of the components in solution form is typically prepared. By way of example, if palladium, particularly palladium in salt form, is to be added to the tobacco smoking mixture, the palladium may be added to the liquid solution with the glycerin and sprayed onto the tobacco. Likewise, if magnesium salts, calcium salts or a mixture thereof are to be added to the tobacco smoking mixture, these salts may be added to the liquid solution with the glycerin and sprayed onto the tobacco. The mixture can then be processed using conventional techniques for preparation of the tobacco smoking mixture for use in a smoking article.

The tobacco smoking mixture may comprise a tobacco column of a cigarette. The tobacco column may be surrounded by a wrapper to form a tobacco rod. In addition, an optional filter may be disposed at one end of the tobacco rod of the cigarette. Techniques for assembling a cigarette from these components are conventional in the art.

The tobacco smoking mixtures, when used in smoking articles, reduce cytotoxicity and/or mutagenicity of the tobacco smoke produced by the smoking article upon burning. Thus, a method of reducing cytotoxicity and/or mutagenicity in tobacco smoke is provided comprising applying a solution comprising a mixture of glycerin and a palladium salt onto tobacco cut filler to form a tobacco smoking mixture capable of producing tobacco smoke when burned, forming a smoking article comprising a wrapper, the tobacco smoking mixture and a filter, and burning the smoking article to produce tobacco smoke with reduced cytotoxicity and/or mutagenicity. The mixture of glycerin and palladium salt is present in an amount effective to reduce the cytotoxicity and/or the mutagenicity of the smoke produced from the tobacco smoking mixture upon burning. Preferably, the glycerin is used in an amount of about 8 to about 13% by weight of the tobacco smoking mixture and the palladium salt is used in an amount of about 0.03 to about 0.10% by weight of the tobacco smoking mixture.

Alternatively, a method of reducing cytotoxicity and/or mutagenicity in tobacco smoke is provided comprising applying a solution comprising a mixture of glycerin, and a magnesium salt, a calcium salt, or a mixture thereof onto tobacco cut filler to form a tobacco smoking mixture capable of producing tobacco smoke when burned, forming a smoking article comprising a wrapper, the tobacco smoking mixture and a filter, and burning the smoking article to produce tobacco smoke with reduced cytotoxicity and/or mutagenicity. The mixture of glycerin and magnesium salt or calcium salt is present in an amount effective to reduce the cytotoxicity and/or the mutagenicity of the smoke produced from the tobacco smoking mixture upon burning. Preferably, the glycerin is used in an amount of about 8 to about 13% by weight of the tobacco smoking mixture and the magnesium or calcium salt is used in an amount of about 3 to about 8% by weight of the tobacco smoking mixture. Preferably, the magnesium or calcium salt is magnesium nitrate, magnesium chloride, magnesium acetate, magnesium sulfate, calcium nitrate, calcium chloride, calcium acetate, calcium sulfate or mixtures thereof.

The following examples are given to illustrate embodiments of the tobacco smoking mixtures and should not be construed to limit the scope of such embodiments.

Example 1

Glycerin was added to tobacco cut filler in an amount of 10% by weight to form a tobacco smoking mixture. Using the Ames test, the test results on the tobacco smoking mixture compared to a control cigarette containing tobacco cut filler without glycerin showed the following reduction in tobacco smoke for total particulate phase (TPM):

TPM mutagenicity (TA98 with S9): −12%

The tobacco smoking mixture containing tobacco cut filler with 10% glycerin was also tested using the neutral red uptake assay. The neutral red cytotoxicity assay is a sensitive assay for assessing the cytotoxic potential of cigarette smoke condensates. The neutral red uptake assay was conducted by methods known to those of skill in the art The results of the neutral red uptake assay on cigarette smoke generated from a tobacco smoking mixture comprising tobacco cut filler and 10% by weight glycerin showed a total particulate phase (TPM) cytotoxicity of −36.4 and a gas vapor phase (GVP) cytotoxicity of −20.9%.

Example 2

Glycerin in an amount of 10% by weight and palladium salt in an amount of 0.07% by weight were added to tobacco cut filler to form a tobacco smoking mixture. The cytotoxicity and mutagenicity were measured using the Bio-Rapid Screening test (Ames test) and a neutral red uptake assay. The TPM mutagenicity of the tobacco smoking mixture including 10% glycerin and 0.07% palladium showed a reduction of −66%. The TPM cytotoxicity using the neutral red uptake assay showed a reduction of −44.5%. The GVP cytotoxicity using the neutral red uptake assay showed a reduction of −22.0%. These reductions were measured relative to controls.

Example 3

Magnesium and calcium salts were applied to tobacco cut filler and the tobacco was tested for reduction of cigarette smoke cytotoxicity and mutagenicity. A number of tobacco smoking mixtures were prepared which included 5% of one of magnesium nitrate, magnesium chloride, magnesium acetate, magnesium sulfate, calcium nitrate, calcium chloride, calcium acetate and calcium sulfate. The studies showed that a reduction of more than 50% of hydroquinone in cigarette smoke TPM was achieved for each salt.

Example 4

Calcium chloride was applied in a mixture with glycerin to tobacco cut filler to form a tobacco smoking mixture. The tobacco smoking mixture included 5% by weight of magnesium chloride with 8% glycerin applied on tobacco cut filler. The tobacco smoking mixture prepared was tested and compared to a control cigarette. The test results showed a reduction of more than 70% hydroquinone in the cigarette smoke. A significant reduction in TPM mutagenicity would be expected in view of this amount of reduction of hydroquinone given the cocarcinogen and tumor promoter nature of hydroquinone in smoke.

Example 5

Test cigarettes were prepared and treated with magnesium acetate and glycerin and magnesium acetate, glycerin and palladium. The test cigarettes were subjected to screening for cytotoxicity and mutagenicity. The results were compared with control cigarettes sprayed with water.

Cigarette Information:

Control cigarettes: water sprayed

Test 1 cigarettes: 5% magnesium acetate

Test 2 cigarettes: 5% magnesium acetate+10% glycerin sprayed

Test 3 cigarettes: 5% magnesium acetate+10% glycerin and 0.07% Pd ($K_2PdCl_4$) sprayed.

Test Results:

TPM mutagenicity (TA 98 with S9):

5% magnesium acetate: −0%

5% magnesium acetate+10% glycerin sprayed: −37%

5% magnesium acetate+10% glycerin and 0.07% Pd ($K_2PdCl_4$) sprayed: −58%

TPM cytotoxicity (neutral red uptake assay)

5% magnesium acetate: −19%

5% magnesium acetate+10% glycerin sprayed: −45%

5% magnesium acetate+10% glycerin and 0.07% Pd ($K_2PdCl_4$) sprayed: −54%

While the tobacco smoking mixtures have been described in detail with reference to specific embodiments thereof, it will be apparent to one skilled in the art that various changes and modifications can be made, and equivalents thereof employed, without departing from the scope of the claims.

The invention claimed is:

1. A tobacco smoking mixture capable of producing smoke when burned comprising tobacco and a mixture of glycerin and a magnesium or calcium salt selected from the group consisting of magnesium nitrate, magnesium acetate, magnesium sulfate, calcium nitrate, calcium acetate, and mixtures thereof, wherein the glycerin is present in an amount of about 8 to about 13% by weight of the tobacco smoking mixture, and wherein the mixture of glycerin and the magnesium or calcium salt is present in an amount effective to reduce the cytotoxicity and/or the mutagenicity of the smoke produced when the tobacco smoking mixture is burned.

2. The tobacco smoking mixture according to claim 1, wherein the magnesium or calcium salt is in an amount of about 3 to about 8% by weight.

3. The tobacco smoking mixture according to claim 1, wherein the magnesium or calcium salt is in an amount of about 4 to about 6% by weight.

4. The tobacco smoking mixture according to claim 1, wherein the tobacco smoking mixture further comprises palladium.

5. The tobacco smoking mixture according to claim 4, wherein the palladium is present in an amount of about 0.03 to about 0.10% by weight of the tobacco smoking mixture.

6. The tobacco smoking mixture according to claim 1, wherein the tobacco smoking mixture comprises a tobacco rod of a cigarette.

7. The tobacco smoking mixture according to claim 6, wherein the tobacco rod is surrounded by a wrapper and a filter is at one end of the wrapper.

8. The tobacco smoking mixture according to claim 1, wherein the tobacco smoking mixture comprises tobacco and a mixture of glycerin and a calcium salt selected from the group consisting of calcium nitrate, calcium acetate, and mixtures thereof.

9. The tobacco smoking mixture according to claim 1, wherein the tobacco smoking mixture further comprises a palladium salt.

10. The tobacco smoking mixture according to claim 1, wherein the tobacco smoking mixture further comprises a water-soluble palladium salt.

11. A tobacco smoking mixture capable of producing smoke when burned comprising at least about 85% by weight tobacco cut filler and about 8 to about 13% by weight glycerin and at least one magnesium or calcium salt selected from the group consisting of magnesium nitrate, magnesium acetate, magnesium sulfate, calcium nitrate, calcium acetate, and mixtures thereof, wherein the glycerin effectively reduces the cytotoxicity and/or mutagenicity of the smoke produced when the tobacco smoking mixture is burned by at least about 10% of smoke particulate phase cytotoxicity and/or mutagenicity.

12. A tobacco smoking mixture capable of producing smoke when burned comprising at least about 85% by weight tobacco cut filler and about 3 to about 8% by weight of a magnesium or calcium salt selected from the group consisting of magnesium nitrate, magnesium acetate, magnesium sulfate, calcium nitrate, calcium acetate, and mixtures thereof, wherein the magnesium or calcium salt effectively reduces the cytotoxicity and/or mutagenicity of the smoke produced when the tobacco smoking mixture is burned by at least about 10% of smoke particulate phase cytotoxicity and/or mutagenicity.

* * * * *